United States Patent [19]

Guth, deceased

[11] 3,985,023

[45] Oct. 12, 1976

[54] DOOR LATCH CONTROL MEANS FOR A DISHWASHER

[75] Inventor: Lauren W. Guth, deceased, late of Louisville, Ky., by Margaret DeGaris Guth, heir

[73] Assignee: General Electric Company, Louisville, Ky.

[22] Filed: Nov. 4, 1975

[21] Appl. No.: 628,813

[52] U.S. Cl. ..... 70/267; 134/58 D; 292/7

[51] Int. Cl.[2] ..... B08B 3/00; E05B 43/00

[58] Field of Search ..... 70/267, 269; 292/7; 126/197; 134/58 D, 188; 312/333

[56] References Cited

UNITED STATES PATENTS

| | | | |
|---|---|---|---|
| 2,713,345 | 7/1955 | Stanitz et al. | 134/58 D |
| 2,960,046 | 11/1960 | Clark | 70/267 |
| 3,099,471 | 7/1963 | Scott et al. | 292/7 |
| 3,317,708 | 5/1967 | Bowling | 292/7 |

*Primary Examiner*—Casmir A. Nunberg
*Attorney, Agent, or Firm*—Francis H. Boos

[57] ABSTRACT

A door latch control means for a dishwasher is disclosed which includes a mechanical linkage associated with the dishwasher timer to unlatch the door at the onset of the drying portion of the cycle. A first lever is pivotally mounted and spring biased to be tripped by the timer whereupon a pin on the first lever strikes a second lever, thereby causing the second lever to be moved upwardly. A forked trip lever is pivotally connected to the second lever to unlatch a door latch trip and allow the door to swing partially open.

3 Claims, 6 Drawing Figures

DOOR LATCH CONTROL MEANS FOR A DISHWASHER

BACKGROUND OF THE INVENTION

In the operation of a household dishwasher, it is desirable to provide an arrangement whereby the door can be automatically opened at the end of the last rinse cycle to promote natural drying of the dishes therein. Such an arrangement allows the heat within the dishwasher, plus convection currents, to effect drying of the dishes and, in most cases, obviates the need for an electrical heater.

There are, however, certain requirements that must be met with such an automatic opening arrangement. Firstly, the arrangement must allow the opening and closing of the dishwasher door during the wash cycles, as well as during the drying period. Secondly, it is desirable that the operator of the dishwasher be enabled to select the "natural dry" feature or, in the alternative, allow the dishes to be dried in the more conventional forced-air circulating manner. Further, it is desirable that the opening function be accomplished by the timer of the dishwasher without the use of any electrical solenoid or other such device.

U.S. Pat. No. 2,960,046 shows a timer-controlled latch mechanism for an incinerator. However, beyond the concept of a latch controlled by the timer mechanism, the structure described therein is completely unlike applicant's arrangement and is not applicable to meet the needs described hereinabove. The invention herein is a simple, straightforward, readily employed, and easily maintained latch control means for a dishwasher, which latch device allows opening and closing of the dishwasher in a normal fashion, as well as automatic opening of the dishwasher by the timer.

SUMMARY OF THE INVENTION

The present invention is a door latch control means for a dishwasher which includes a linkage arrangement operated by the dishwasher timer. The linkage arrangement transmits motion from a timer cam follower to actuate the door latch mechanism. The timer is programmed to actuate the latch mechanism after the last rinse of the dishwasher cycle, thereby allowing the door to open a small amount and promote natural drying of the dishes in the dishwasher. The linkage mechanism is constructed to provide that the dishwasher may be opened and closed at any point in its operating cycle, including the drying portion thereof, without interference therefrom. The dishwasher, in fact, may be closed after it has been automatically opened during the natural dry cycle. Then the timer may be reset, if desired, without interference from the linkage arrangement. More specifically, the invention includes a door latch control means for a dishwasher comprising: a timer having a notched cam surface; a first lever having first and second ends and a cam follower disposed intermediate said ends, said first lever being pivotally supported by the door at its first end, a spring biasing means supported by said door and preselectively attached to said first lever to urge said cam follower into contact with the cam surface; a post projecting from said first lever and located remote from said first end thereof; a stop preselectively positioned on the door near said first lever; a second lever having a first end and a second bifurcated end, said second end being located in operating position with respect to a latch release attached to the door, said second lever further being supported on said dishwasher door by a pivotal mounting means intermediate its ends; a third lever means attached to and supported by said second lever, said third lever means including a biasing means attached adjacent one end thereof to urge said third lever into abutting relationship with said stop, thereby aligning the distal end of said third lever in blow-receiving relationship to said projection of said first lever when said cam follower is abutting said cam surface, said biasing means urging said third lever to a non-interferring position after being struck by said projection when said cam follower falls into a notched portion of said cam.

DESCRIPTION OF THE PREFERRED EMBODIMENT

Figure 3:
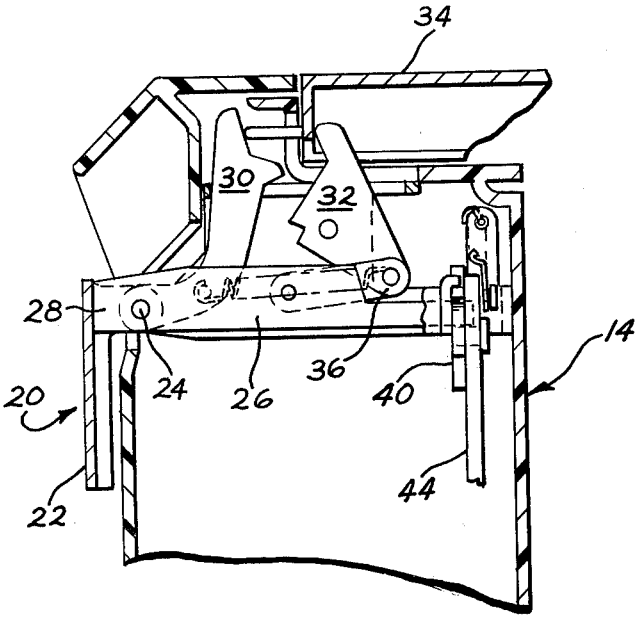
FIG. 3 is a view similar to FIG. 2 showing the latch in its latched position.
Figure 2:
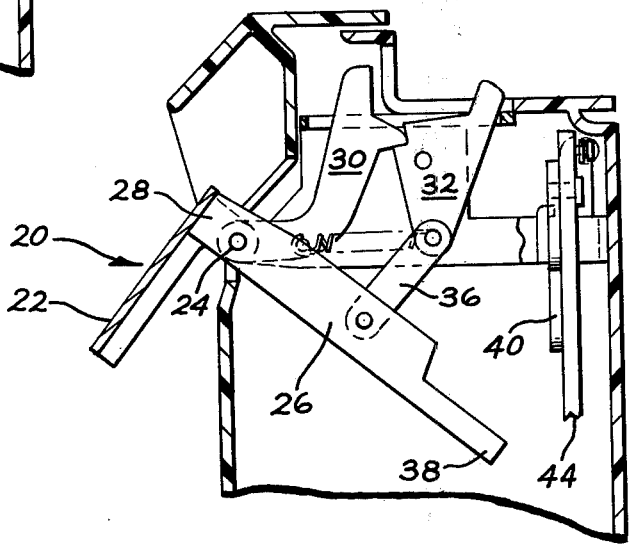
FIG. 2 is a partial, cross-sectional view of a dishwasher door showing the latch arrangement in its unlatched position.
Figure 1:
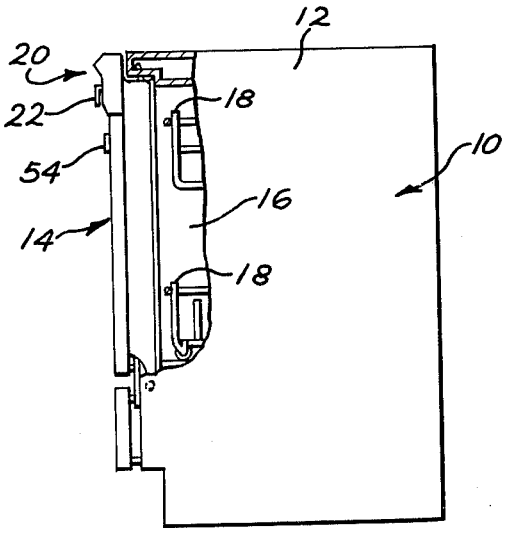
FIG. 1 is an elevational view of a dishwasher including the present invention.

FIG. 1 shows an automatic dishwasher 10 having an outer cabinet 12 and a door 14 defining therewithin a wash chamber 16. Article-receiving racks 18 are located therewithin and adapted to be moved outwardly on track means, or the like, for loading of dishes to be washed in the dishwasher. The door includes latch means 20, more clearly shown in FIGS. 2 and 3. The latch means 20 includes a handle 22 pivotally connected by pin 24 to the door. A lever 26 is fixedly connected at its first end 28 to handle 22. The lever 26 extends outwardly from handle 22 and pivots between first and second positions, the first position being an open position, as shown in FIG. 2, and the second position being a closed position, as shown in FIG. 3.

A detent 30 of the latch is pivotally connected to the frame by pin 24. The detent is movable between first and second positions, engaging keeper 32 and remote from keeper 32, respectively. It can be seen that when keeper 32 is engaged by detent 30, it does not contact strike 34 and thus the door can easily be opened and closed. In the alternative, when detent 30 is not engaging keeper 32, the handle can be pushed downward toward the door, thereby latching the door securely against strike 34. The linkage arrangement 36 is slightly overcenter when the keeper is in its latched position.

Importantly, it can be seen that the distal end 38 of lever 26 engages with bifurcated lever 40 of the dishwasher latch control means of the present invention to provide for timer unlatching of the door.

Figure 4:
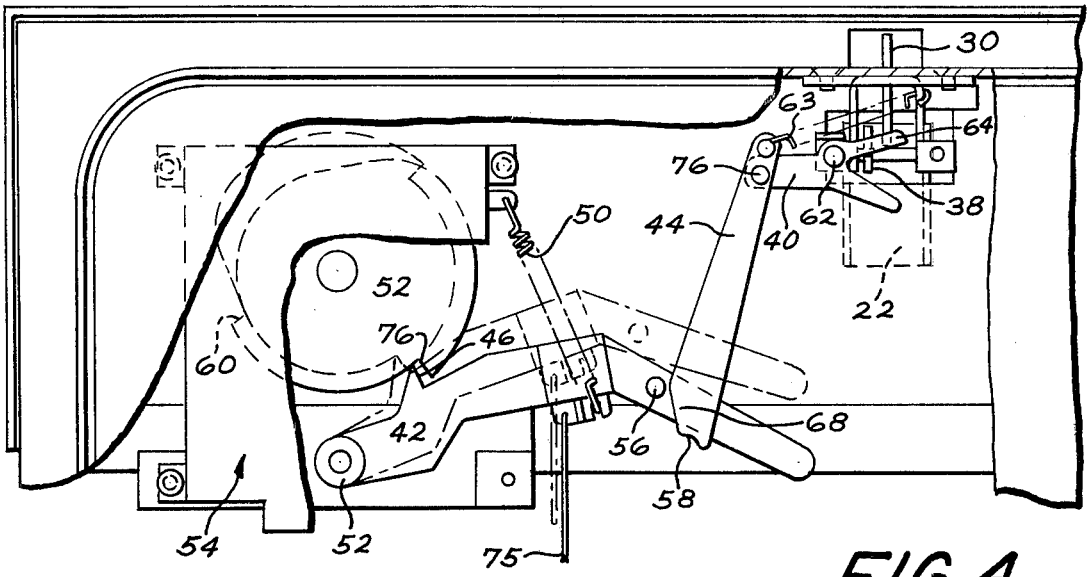
FIG. 4 is a partial, elevational view of the door latch control of this invention.
Figure 5:
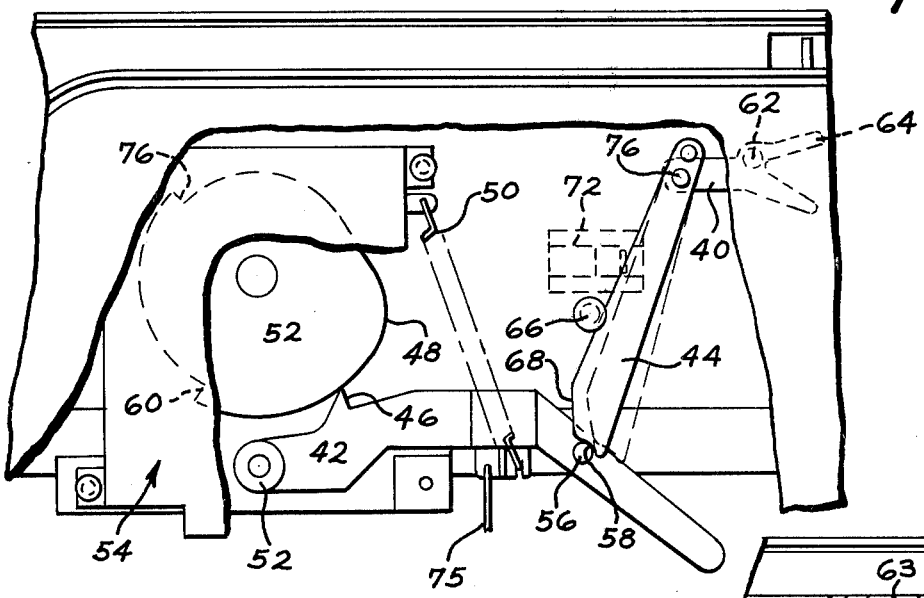
FIG. 5 is a view similar to FIG. 4 showing the latch control just prior to unlatching the door.
Figure 6:
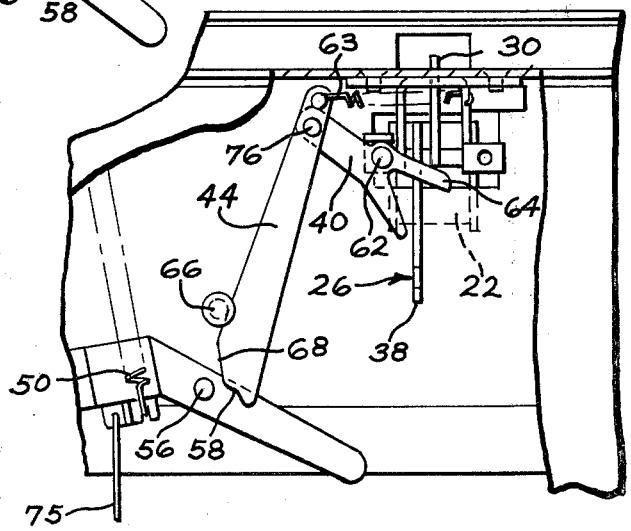
FIG. 6 is a partial, elevational view showing the latch control mechanism after the door has been unlatched.

Looking now at FIGS. 4, 5, and 6, it can be seen that the linkage control of this invention includes pivoted lever 42, pivoted lever 44, and, of course, bifurcated lever 40. Lever 42 includes a cam follower 46 which engages the cam surface 48 provided by the timer 54. Spring 50 biases cam follower 46 against the cam surface by virtue of its attachment to lever 42. Spring 50 is preselected to be of sufficient strength to trip the latch means 20, as will be more fully described hereinafter, yet not so strong that it prevents the timer cam 52 from rotating when cam follower 46 is urged thereagainst. Lever 42 is, of course, pivoted at pivot 52, which pivot is attached to the timer mechanism 54. Also included on lever 42 is a post or projection 56 which is movable to align with notched end 58 of lever 44.

During the initial rinse portions of the dishwasher cycle, lever 42 follows the cam surface 48 and is generally in the position shown in solid lines in FIG. 4. As the dishwasher begins its cycle, the irregular cam surface has rotated so that cam follower 46 falls into notch 76, thereby causing lever 42 to shift to its uppermost position as shown in dashed lines in FIG. 5.

Tension means 75 may be attached at one end to lever 42 and at the other to the detergent cup. The detergent cup will then be tripped when cam follower 46 falls into a notch 76 on the cam surface. The position of lever 42, after the detergent cup is tripped, is shown in dashed lines in FIG. 4.

The cam surface continues to rotate as the dishwasher cycle continues until cam follower 46 falls into notched position 60 at the onset of the drying cycle. As a consequence of cam follower 46 falling into notched portion 60, lever 42 pivots, thereby causing pin 56 to strike the end of lever 44. When lever 44 is struck and moved upwardly, bifurcated lever 40 is caused to pivot about pivot 62. Leg 64 thereby engages distal end 38 of lever 26 to release latch means 20.

In this regard, spring 64 maintains lever 44 biased against stop 66 to insure that it is in proper position to be struck by projection 56. The result is the tripped arrangement shown in FIG. 6.

It should be noted that, after tripping, the lever 44 is now in a new position and, due to the tapering of its width adjacent notched end 58, projection 56 is no longer able to contact lever 44. Also, the beveled edge 68 of lever 44 insures that there will be no interference from the linkage arrangement and the dishwasher may be freely opened and closed even during the drying cycle. It is readily apparent that levers 40 and 44 are connected at pivot 70. It is through this pivot that the initial upward force is transmitted to bifurcated lever 40 during unlatching of the door.

It can be observed from FIG. 5 that a selection means 72 can be provided to allow the user to select the pop-open drying feature or, in the alternative, reject that feature. Selection means 72 includes a movable projection 74 which, when moved to the right, engages lever 44 and conveniently moves it out of alignment with projection 56 so that no striking of lever 44 is possible.

Thus, what is shown and described in a unique linkage which provides for the tripping of a detergent cup, as well as the opening of the dishwasher door, at the onset of the drying cycle, of a dishwasher. The linkage allows the dishwasher door to be opened for addition of dishes or inspection at any point in the cycle without disturbing the function of the timer in providing the automatic opening feature.

Having thus described the invention, what is claimed is:

1. A door latch control means for automatically opening the door of a dishwasher during the drying cycle, comprising:

a timer having a notched cam surface;

a first lever having first and second ends and a cam follower disposed intermediate said ends, said first lever being pivotably supported by said door at its first end;

a spring-biasing means supported by said door and preselectively attached to said first lever to urge said cam follower into contact with said cam surface;

a post projecting from said first lever and located remote from said first end thereof;

a stop preselectively positioned on said door near said first lever;

a second lever having a first end and a second bifurcated end, said second end being located in operating position with respect to a latch release attached to said door, said second lever further being supported on said dishwasher door by a pivotal mounting means intermediate said ends; and a third lever means attached to and supported by said second lever, said third lever means including a biasing means attached adjacent one end thereof to urge said third lever into abutting relationship with said stop, thereby aligning the distal end of said third lever in blow-receiving relationship to said projection of said first lever when said cam follower is abutting said cam surface, said biasing means urging said third lever to a non-interferring position after being struck by said projection when said cam follower falls into a notched portion of said cam.

2. The door latch control means of claim 1 including selection means cooperable with said third lever to afford optional selection of the automatic door-opening function.

3. The door latch control means of claim 1 including a tension means attached to said first lever to effect operation of the dishwasher detergent cup during the dishwasher cycle.

* * * * *